United States Patent [19]

Lee

[11] Patent Number: 4,984,764

[45] Date of Patent: Jan. 15, 1991

[54] FORM WITH FORM STRIPPING MECHANISM

[76] Inventor: Yuan-Ho Lee, No. 851, Chung-San Rd., Nan-Pao Tsun, Kuei-Jen Hsian, Tainan Hsieng, Taiwan

[21] Appl. No.: 371,297

[22] Filed: Jun. 26, 1989

[51] Int. Cl.[5] ..... E04G 11/20

[52] U.S. Cl. ..... 249/33; 249/20; 249/35; 249/39; 249/68; 249/219.1; 425/63

[58] Field of Search ..... 249/1, 4, 5, 8, 13, 249/18, 19, 20, 33, 34, 35, 39, 68, 219.1; 425/63, 65; 264/33, 34

[56] References Cited

U.S. PATENT DOCUMENTS

| | | | |
|---|---|---|---|
| 821,277 | 5/1906 | Bellars | 249/39 |
| 1,132,460 | 3/1915 | Dewey | 249/20 |
| 3,663,132 | 5/1972 | Andersson | 249/17 |
| 3,676,536 | 7/1972 | Shelley | 249/1 |
| 4,016,228 | 4/1977 | Schmidt | 249/20 |
| 4,397,441 | 8/1983 | Manderla | 249/19 |
| 4,667,923 | 5/1987 | Lee | 249/19 |

FOREIGN PATENT DOCUMENTS

| | | | |
|---|---|---|---|
| 836320 | 6/1981 | U.S.S.R. | 249/18 |

*Primary Examiner*—James C. Housel

*Attorney, Agent, or Firm*—Ladas & Parry

[57] ABSTRACT

A forming device includes two opposite form boards, an upper fastening unit mounted on the first and second top ends of the form boards, an upper hydraulic drive unit cooperably connected to the fastening unit and a lower hydraulic drive unit mounted on the bottom end of the first or second form board. The fastening unit includes a slide device to permit the first and second form boards to move away from one another or to approach one another. The slide device includes a slide bar fixed to the first or second top end of the form board, and a support bar fixed to the second or first top side. An upper hydraulic drive unit is cooperably connected to the slide bar and the support bar. A lower hydraulic drive unit is mounted on the bottom end of the first or second form board to move the form board relative to the formed concrete. The form boards can be stripped from a formed wall in a proper direction without causing the boards to swing and possibly damage the projecting portions of the formed wall.

6 Claims, 6 Drawing Sheets

FORM WITH FORM STRIPPING MECHANISM

BACKGROUND OF THE INVENTION

This invention relates to a forming device, and particularly to a hydraulically operated form stripping mechanism which can simultaneously strip form boards from a formed concrete wall.

Forming devices of the above-described type exist in numerous forms in the art. Some of the forming devices include a collapsible frame which moves form boards used for forming culverts, tunnels or the like. Forming devices used for forming box-like concrete structures also include a collapsible core form which can be stripped from the inner surface of the formed enclosed wall of the box-like structure. There are also form board assemblies for forming concrete blocks, concrete columns, etc, which can be simultaneously stripped from the outer surface of the formed structure.

It is a common practice for projecting parts of a wall such as flanges A formed at doors or windows which guide water flowing down from roofs and upper parts of walls, decorative flanges D,C, and projecting supports for mounting an air-conditioner B all of which are shown in FIG. 1, are formed separately from the formation of the wall from which they project, by setting up a form on the basic wall after the basic wall is formed. This process is time consuming. It is now possible to form vertical concrete walls having the above described projecting parts by using form panels having grooves or cavities therein. However, the edges of these projecting parts easily break if the form panels swing or do not move properly when they are stripped mechanically from the formed concrete structure. Therefore, it is desirable to present a particular mold stripping mechanism to strip form panels from the type of the vertical wall described above.

SUMMARY OF THE INVENTION

It is an object of the invention to provide an improved forming device in which form panels can be stripped from a vertical wall in a proper direction without causing form panels to swing so that the risk of breaking projecting concrete parts formed on a vertical wall can be reduced.

According to the present invention, a forming device comprises a first form board, a second form board to confine a cavity for receiving concrete, and an upper fastening means mounted on the first and second top ends to fasten the first and second top ends which include a slide means to permit the first and second form boards to either move away from one another or to approach one another. The slide means includes a slide bar fixed to the first or second top side, and a support bar fixed to the second or first top side. The slide bar and the support member projecting in opposite directions from the first and second form boards and being able to engage slideably with one another. An upper hydraulic drive means is cooperably connected to the slide bar and the support bar, and a lower hydraulic drive means is mounted on the first or second bottom end to move the form board relative to the formed concrete.

The slide bar extends in a direction normal to the first or second forming face, and the rail member extends in a direction normal to the second or first forming face. The upper fastening means further includes a mounting member secured to the second or first top end, the mounting member having two spaced apart brackets which project upward and forward to support the rail member.

The support bar has a front plate provided with a slide groove at the bottom side thereof, and the slide bar has an engaging portion at a top side thereof, the slide bar extending into the space between the spaced apart brackets, and the engaging portion engaging with the slide groove during operation.

The upper hydraulic drive means is mounted on the mounting member and extends along the direction of the support bar. The hydraulic drive means has a piston rod to be connected to the slide bar.

The lower hydraulic drive means extends in a direction normal to the first or second forming face, and includes a hydraulic cylinder mounted on the first or second bottom ends and a piston rod which extends below the first or second bottom end to bear against a structure provided below the concrete formed by the molding device.

The present exemplary preferred embodiment will be described in detail with reference to accompanying drawings, in which:

DETAILED DESCRIPTION OF THE PREFERRED EMBODIMENT

Figure 1:
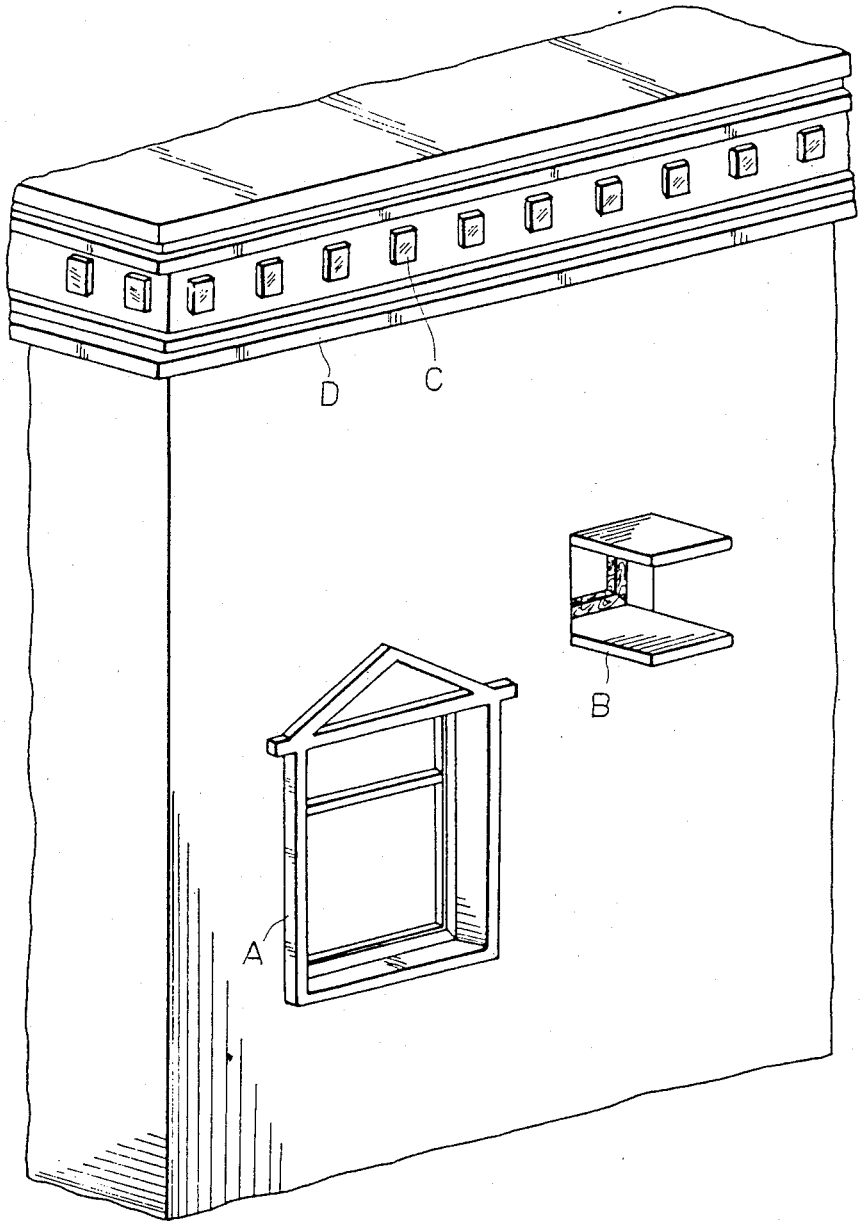
FIG. 1 shows a wall having projecting portions.

Referring to FIG. 1, a portion of a forming device according to the present invention is shown, including a first form board 1 and an opposite second form board 2 which are installed in a spaced apart relationship by using tie rods, fasteners, etc., (not shown) in a conventional way. The form boards 1 and 2 confine a cavity for receiving concrete. Upper hydraulic drive members 5 are provided on the top sides of the first and second form boards 1, 2. Lower hydraulic drive members 5 are respectively mounted on the bottom sides of the first and second form boards.

Figure 2:
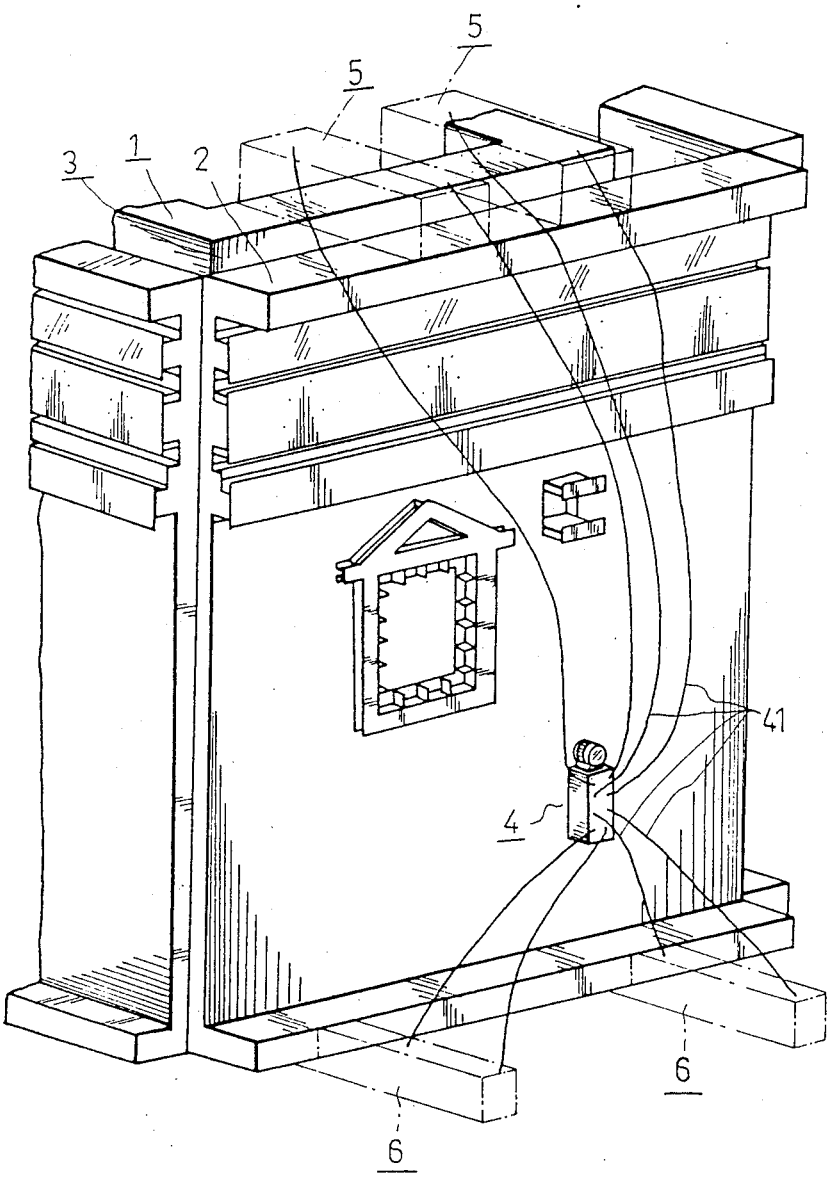
FIG. 2 shows a schematic perspective view of a forming device of the present invention in a forming position.
Figure 3:
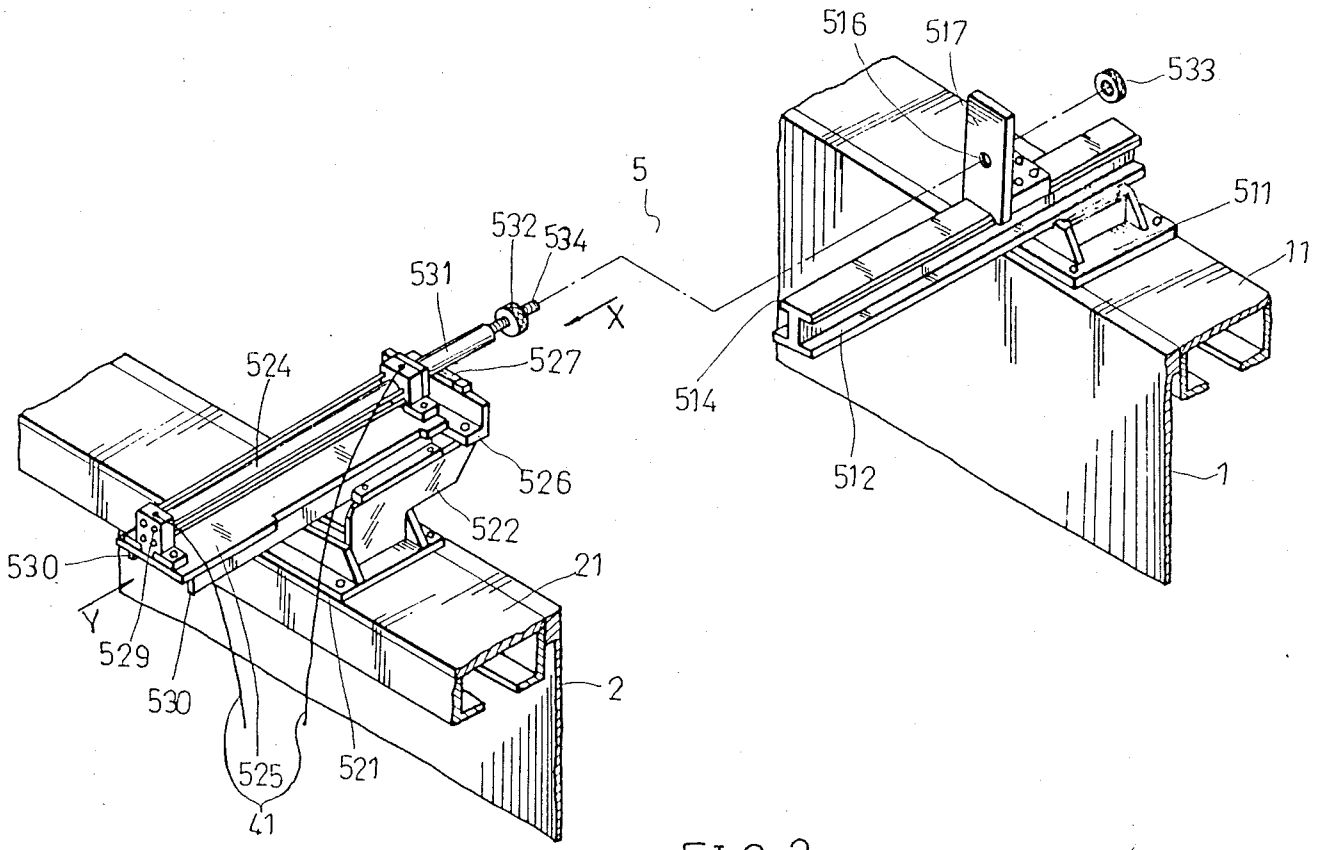
FIG. 3 shows a perspective view showing an upper hydraulic drive mechanism mounted on the top of the form board of the present invention.
Figure 4:
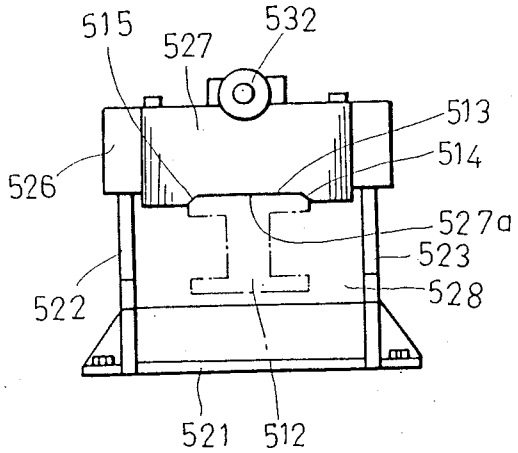
FIG. 4 is an elevation view as viewed from the direction designated by arrow X.

As shown in FIGS. 2, 3 and 4, each upper hydraulic drive member 5 includes a first mounting plate 511 which is secured to a reinforcement bar 11 at the top side of the form board 1, a slide bar 512 having an I-shaped cross-section and fixed to the mounting plate 511, a bearing plate 517 secured to the slide bar 512, a second mounting plate 521 secured to a reinforcement bar 21 provided on the top side of the form board 2, a support bar 525 secured to the second mounting plate 521, and a hydraulic cylinder 524 mounted securely on the support bar 525.

The second mounting member 521 has two brackets 522, 523 which are secured thereto and extend upward to hold the support bar 525. An angled plate 526 is secured to the brackets 522, 523 and a front plate 527 is secured to the angled plate 526. Two guide members 530 are formed on the bottom side of the support bar 525. The brackets 522, 523 and the support bar 525 confine a space to permit the slide member 512 to extend thereinto. The slide bar 512 and the support bar 525 projects in opposite directions from the first and second form boards 1 and 2. The front plate 527 is provided with a slide groove 527*a* to receive an upper part 514 of the slide bar 512.

At two ends of the hydraulic cylinder 524 are two hydraulic containers 529 which are mounted on the support bar 525 and which are provided with oil conduits 41. A piston rod 531 of the cylinder 524 has a threaded end 534 to pass through a hole 516 of the bearing plate 517 of the first form board 1. Nuts 532, 533 are provided on the threaded end 534.

Figure 5:
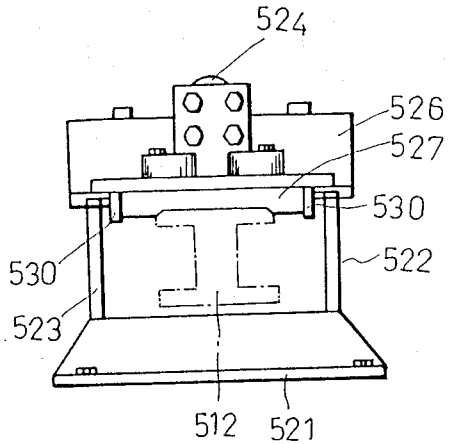
FIG. 5 is an alevation view as viewed from the direction designated by arrow Y.
Figure 6:
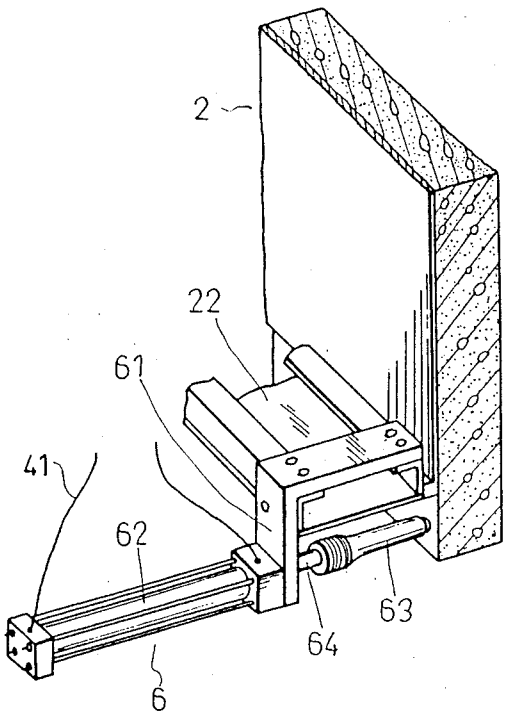

Referring to FIGS. 5 and 6, each lower hydraulic drive member 6 includes a mounting member 61 which is secured to a lower reinforcement channel bar 22 of the form board 2. A hydraulic cylinder 62 is secured to the mounting member 61 and incorporates a piston rod 64 with an adjustment member 63. With the adjustment member 63, the piston rod 64 can be adjusted to extend to a bearing wall above which a new concrete wall will be formed by the form boards 1 and 2.

Figure 7:
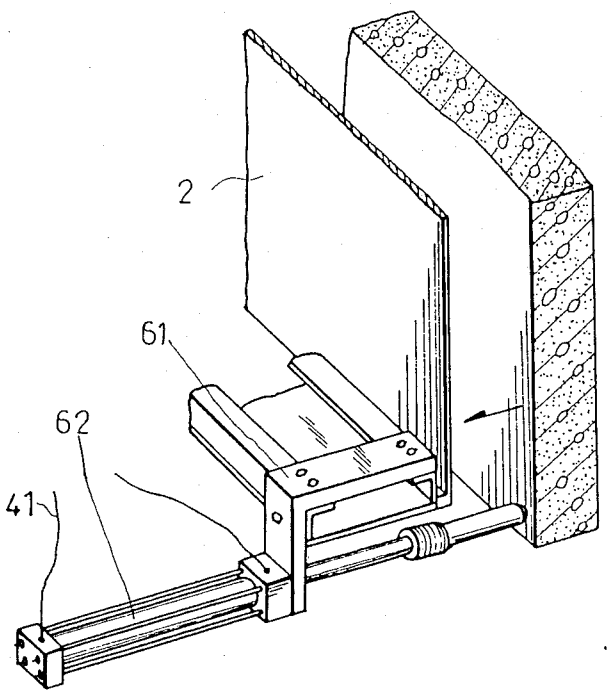
FIGS. 6 and 7 show hydraulic drive units provided at the bottom side of the form board.

The slide bar 512 can extend into the space 528 created in the second mounting member 521 by slightly lifting and moving the first form board 2 toward the second form board 1. The slide bar 512 is then engaged with the the slide groove 527*a* of the front plate 527, and the threaded end 534 of the piston rod 531 is threaded through the hole 516 of the bearing plate 517 and fixed thereto by tightening the nuts 532, 533, thereby fastening the top ends of the form boards 1 and 2, as shown in FIG. 7.

Figure 8:
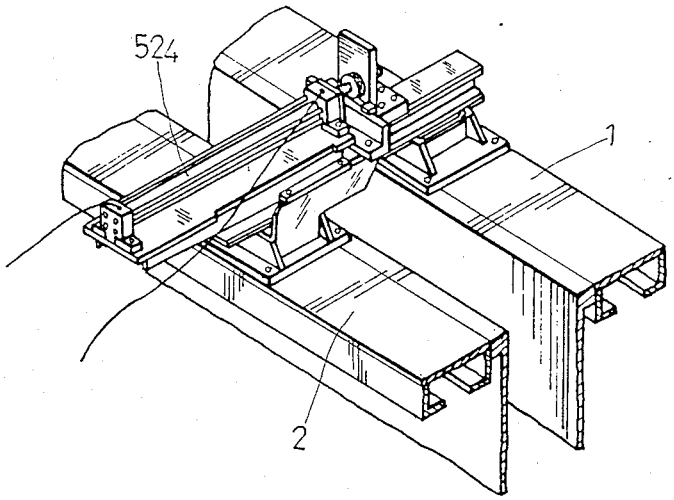
FIG. 8 shows the upper hydraulic drive member of the present invention when the two form boards are fastened together.
Figure 9:
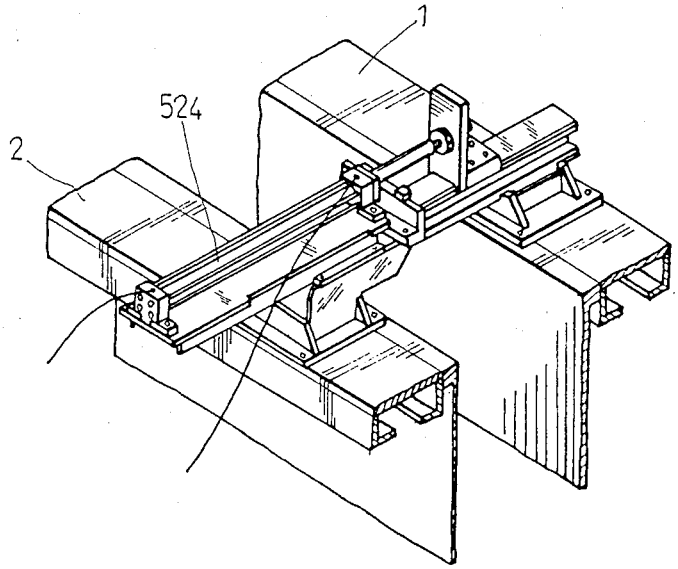
FIG. 9 shows the upper hydraulic drive member when a form board is moved away from the formed concrete.

The operation of stripping form boards of the present invention from an outer side of a vertical wall having projecting parts as shown in FIG. 1 is described hereinbelow. Hydraulic drive members 5 and 6 are operated simultaneously through a control unit 4. The piston rods 531 which bear against the bearing plates 517 extend forward and move the second form board 2 away from the first form board 1 which is immobilized, as shown in FIG. 8. Simultaneously with the operation of the piston rods 531, the piston rods 64 of the hydraulic cylinders 62 provided at the bottom side of the form board 2 extend forward and move the lower portion of the form board 2.

Since the slide bars 512 and support bars 525 are associated with the hydraulic drive members, and the upper and lower parts of the form board 2 are simultaneously moved, the movement of the form board 2 is guided so as to be in a direction which is normal to the surface of the formed concrete. Accordingly, the the form boards with forming grooves can be released from projecting parts formed on the outer side of the vertical wall without risk of breakage being caused to the projecting parts of the concrete.

With the invention thus explained, it is apparent that various modifications and variations can be made without departing from the scope of the invention. It is therefore intended that the invention be limited only as indicated in the appended claims.

What I claim is:

1. A forming device comprising:

a first form board having a first forming face, a first top end and a first bottom end;

a second form board having a second forming face, a second top end and a second bottom end, said second forming face being opposed to said first forming face to define a cavity for receiving concrete;

an upper fastening means mounted on said first and said second top ends to fasten said first and second top ends together in a spaced apart relationship to each other, said fastening means comprising a slide means to permit said first and second form boards to move away from one another or to approach one another, said slide means including a slide bar fixed to one of said first and second top sides, a support bar fixed to the other one of said first and second top sides, said slide bar and said support bar projecting in opposite directions from said first and second form boards and engaging slideably together;

an upper hydraulic drive means cooperatively connected to said slide bar and said support bar for sliding said slide bar relative to said support bar; and a lower hydraulic drive means mounted on one of said first and second bottom ends to bear against a facing structure to move one of said form boards relative to the concrete which is formed.

2. A forming device as claimed in claim 1, wherein said slide bar extends in a direction normal to one of said first and second forming faces, and said support bar extends in a direction normal to the other of said first and second forming faces.

3. A forming device as claimed in claim 2, wherein said upper fastening means further comprises a mounting member secured to said top end to which said support bar is fixed, said mounting member having two spaced-apart brackets which project upward and toward the opposing form board to hold said support bar.

4. A forming device as claimed in claim 3, wherein said support bar has a front end provided with a front plate which has a slide groove at a bottom side thereof, and said slide bar has an engaging portion at a top side thereof, said slide bar extending into between said spaced apart brackets and said engaging portion engaging with said slide groove.

5. A forming device as claimed in claim 1, wherein said upper hydraulic drive means is mounted on said mounting member and extends along the direction of said support bar, said upper hydraulic drive means having a piston rod connected to said slide bar.

6. A forming device as claimed in claim 5, wherein said lower hydraulic drive means extends in a direction normal to the forming face of the form board to which said lower hydraulic drive means is mounted and comprises a hydraulic cylinder mounted on the bottom end of said form board and a piston rod connected to and activated by said hydraulic cylinder, said piston rod extending below said bottom end to bear against a structure provided below the concrete formed by said forming device.

* * * * *